US008360805B2

(12) United States Patent
Schwarz

(10) Patent No.: US 8,360,805 B2
(45) Date of Patent: Jan. 29, 2013

(54) CONNECTOR BANKS ARRANGED IN PARALLEL AND FLOATING MANNER

(75) Inventor: Volker Schwarz, Sachseln (CH)

(73) Assignee: Huber + Suhner AG (CH)

( * ) Notice: Subject to any disclaimer, the term of this patent is extended or adjusted under 35 U.S.C. 154(b) by 0 days.

(21) Appl. No.: 12/936,553

(22) PCT Filed: Feb. 11, 2009

(86) PCT No.: PCT/EP2009/051602

§ 371 (c)(1),
(2), (4) Date: May 26, 2011

(87) PCT Pub. No.: WO2009/124797

PCT Pub. Date: Oct. 15, 2009

(65) Prior Publication Data

US 2011/0237122 A1 Sep. 29, 2011

(30) Foreign Application Priority Data

Apr. 8, 2008 (CH) ..... 0544/08

(51) Int. Cl.
*H01R 13/514* (2006.01)

(52) U.S. Cl. ..... 439/578

(58) Field of Classification Search ..... 439/578–585
See application file for complete search history.

(56) References Cited

U.S. PATENT DOCUMENTS

| | | | | |
|---|---|---|---|---|
| 5,190,472 | A | 3/1993 | Voltz et al. | |
| 6,524,135 | B1 * | 2/2003 | Feldman et al. | 439/607.46 |
| 6,808,414 | B2 * | 10/2004 | Spiegel et al. | 439/579 |

FOREIGN PATENT DOCUMENTS

| | | |
|---|---|---|
| EP | 0582960 | 2/1994 |
| EP | 1021852 | 7/2000 |
| WO | WO 98/33237 A | 7/1998 |
| WO | WO 98/33243 | 7/1998 |
| WO | WO 02/056426 A | 7/2002 |

OTHER PUBLICATIONS

International Search Report dated Jul. 20, 2009, issued in corresponding international application No. PCT/EP2009/051602.

* cited by examiner

*Primary Examiner* — Chandrika Prasad
(74) *Attorney, Agent, or Firm* — Ostrolenk Faber LLP

(57) ABSTRACT

The present disclosure relates to a multiple coaxial connector (30) having a female connector part and a cable-side male connector part (31,33). The male connector part (31) comprises at least one single-row or double-row connector bank (2) having a housing (6), which has a base body (8) having openings (9) accessible from one or two sides, which are used for receiving individual connectors (4,5).

14 Claims, 5 Drawing Sheets

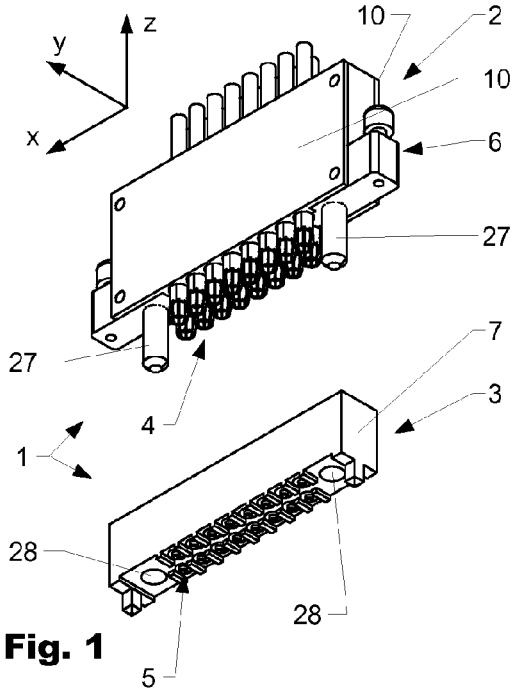
Fig. 1
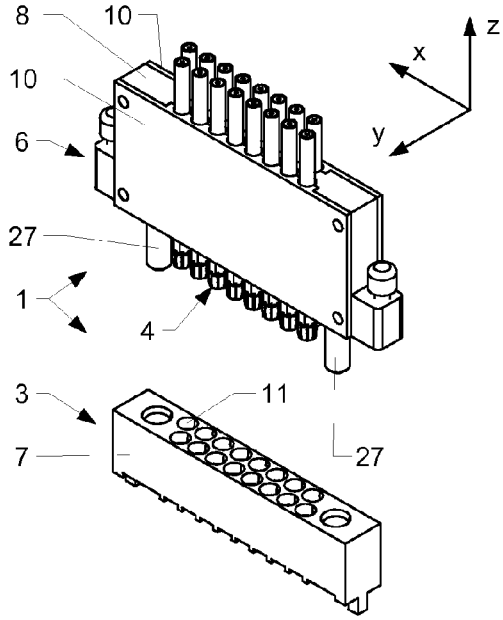
Fig. 2
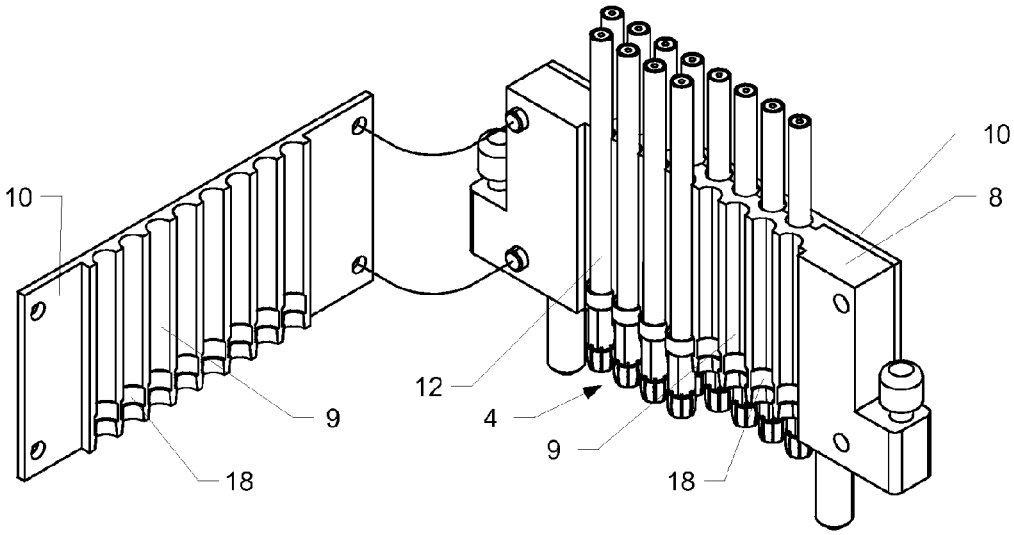
Fig. 3
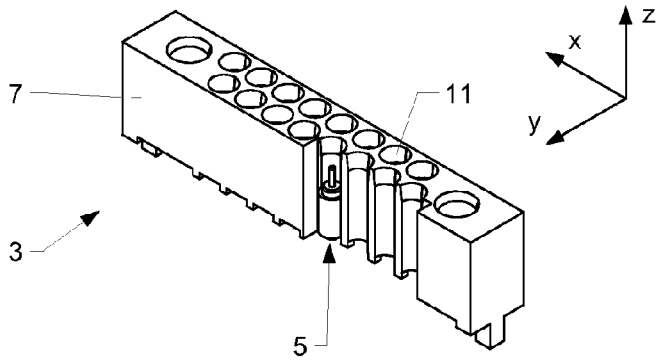

CONNECTOR BANKS ARRANGED IN PARALLEL AND FLOATING MANNER

CROSS REFERENCE TO RELATED APPLICATIONS

The present application is a 35 U.S.C. §371 National Phase conversion of PCT/EP2009/051602, filed Feb. 11, 2009, which claims benefit of Swiss Application No. 00544/08, filed Apr. 8, 2008, the disclosure of which is incorporated herein by reference. The PCT International Application was published in the German language.

BACKGROUND

1. Field of the Disclosure

The invention is found in the field of multiple coaxial connectors according to the preamble of the independent patent claim.

2. Related Art

The prior art discloses multiple coaxial connectors which are suitable for simultaneously connecting a plurality of connectors to a coaxial cable guide. By way of example, the applicant discloses a 16-pin multiple coaxial connector with the product designation Mc16. This connector has a spacing of around 4 mm between the individual connectors and is suitable for frequencies of up to approximately 40 GHz. Likewise known is a single connector with the designation MMPX which is suitable for frequencies up to 65 GHz but has a comparatively high plugging force. Various products which are offered for transmitting signals at high frequencies are known from other manufacturers:

- Gore UHD (coaxial connector, 6-9 GHz, 19 dB, <78 channels per square inch, stamped-and-bent interface, plastic injection-molded housing)
- Tyco Nanonics multi coaxial connector (20 GHz, 2.54 mm center-center pitch, metal housing, similarly D-sub, max 1×9)
- Tensolite HDRFi multi coaxial connector (40 GHz, 3.3 mm center-center pitch, metal housing, similarly D-sub or round, planar contact, approximately 40 channels per square inch in 11-D-sub)
- Synergetix "spring contact fields" (up to 20 GHz, approximately 1.95 mm center-center pitch with the best arrangement for high-frequency contacts, open field, freely configurable, approximately 170 channels per square inch)
- Hirose 2 mm coaxial backplane connector (3 GHz, 7.5 mm center-center pitch, fits in a 2 mm backplane grid)
- backplane connector from Molex/Teradyne, ERNI, FCI (10-20 Gbps, few plugging cycles, density up to 300 channels per square inch)

FCI discloses a connector system with the designation Airmax VS High Speed Connector System. The connectors are constructed from individual layers and do not have a shield. Therefore, they are suitable for transmitting high frequencies only to a limited extent.

EP1021852 was filed in the name of Tyco Electronics and relates to a coaxial RF connector for transmitting radio-frequency electromagnetic waves. The connector has a housing with at least one inner contact and with an outer contact which is arranged coaxially around the inner contact. EP1021852 is based on the object of developing an RF coaxial plug connector which can be produced in a simple and cost-effective manner with a sufficient outer conductor surface thickness. Furthermore, the RF coaxial plug connector which is to be developed should also ensure reliable electrical connection to an outer conductor of a mating coaxial plug, that is to say the outer conductor function. This object is intended to be achieved in that the housing is in the form of a plastic injection-molded part, and in that the housing has a wall section which is composed of plastic and is arranged coaxially around the inner contact, in which wall section at least the inner wall which faces the inner contact is provided with a sufficiently thick metallization layer.

Elektronik [Electronics] 7./8.4.82, page 146 already discloses providing a plastic housing in multipole plug connectors and providing this housing with a surface metallization for shielding purposes. However, these multipole plug connectors are not coaxial plug connectors in which there is always a contact pair comprising an inner contact/coaxial outer contact. Instead, these known plug connectors have a plurality of contact pins which are surrounded by a common housing border which is provided with surface metallization. Therefore, realizing an outer conductor function by means of metalizing a hollow-cylindrical inner wall of the housing does not play any role here.

EP0582960 was filed in the name of Siemens AG and relates to an RF coaxial plug connection with a plurality of coaxial plugs which are arranged at a specific pitch spacing on a substrate, for example a printed circuit board, and corresponding mating coaxial plug connectors which are arranged on a substrate. EP0582960 is based on the object of providing an RF coaxial plug connection which is suitable for a small pitch spacing of, for example, 5 mm, that is to say a mechanically and electrically adapted RF coaxial plug connection, using simplified connection technology. According to the description of EP0582960, the object is achieved by means of an RF coaxial plug connection having the following features: a) the coaxial plugs are secured on their substrate with press-in contacts, b) the mating plug connectors are integrated in a monobloc in a number which corresponds to the number of coaxial plugs, c) the monobloc is composed of conductive material and forms the outer conductor for all the mating coaxial plug connectors integrated in it, d) the inner conductors of the coaxial mating plug connectors and their connections to the substrate are in each case accommodated in an insulated manner in holes in the monobloc, e) the connections of the inner conductors of the coaxial mating plug connectors and the outer conductor connections of the monobloc are in the form of press-in contacts.

U.S. Pat. No. 4,571,014 from AT&T was filed in 1986 and discloses a plug connector with a large number of contacts and a modular, comparatively complicated construction. The connector is assembled from a large number of different parts and is intended to be suitable for use with printed circuit boards. The connector does not have a coaxial construction.

The plug connectors known from the prior art are not suitable for use in an array with a high packing density in the region of 100 channels per square inch, as are used, for example, in test arrangements for testing chips or microprocessors where a large number of connector points have to be simultaneously connected in a narrow space and high frequencies have to be transmitted. One reason for this is that, on account of the design, an arrangement with a corresponding packing density is not possible. It is likewise not possible to guarantee that all the connectors are reliably operatively connected to one another.

U.S. Pat. No. 5,190,472 was applied for by W. L. Gore & Associates, Inc. in 1992 and discloses a multiple coaxial connector which targets a high channel density. Individual coaxial connectors are half-inserted into comb-like, semicircular cutouts, which are arranged opposite one another on two sides, of a so-called grouping module from the side. Since the cutouts surround only half of each connector, the individual connectors are not held in the individual cutouts and fall out of them. The individual connectors are fixed and thus held only by a plurality of grouping modules being laterally layered one on the other. Without the layering, the grouping modules are not functional as such. The layered grouping modules which are fitted with the individual connectors are firmly pressed into an outer frame from behind, and thus joined to form a functional multiple coaxial connector. Although the described principle of a multiple coaxial connector theoretically allows multiple connectors with a comparatively high number of connectors, it has significant disadvantages. Firstly, assembly is extremely difficult. Secondly, the individual, very delicate connectors are held very firmly, and this has a negative effect when mounting connectors with a large number of channels on account of the tolerance chains which develop. A further disadvantage is the large number of very small and different components which are complicated to manufacture and therefore make the corresponding multiple coaxial connectors very expensive.

SUMMARY

One object of the invention is to disclose a multiple coaxial connector which is suitable for use in an array with a high packing density in the region of 100 channels or more per square inch and which does not exhibit the disadvantages associated with the prior art.

This object is achieved by a multiple coaxial connector according to the independent patent claim.

As the packing density (channels per unit area) rises, the individual coaxial connectors and the housing parts holding them are becoming increasingly smaller. As a result, manufacturing tolerances are increasingly coming into play and therefore connectors with a large number of channels are very difficult to produce. This can result in high plugging forces, mechanical deformations or malfunctions. A further problem arises from the difficult logistics of the small parts.

The invention allows for these circumstances by the tolerance chain which is typically produced being interrupted on account of the construction according to the invention and the manner of construction. This is achieved in that a multiple coaxial connector according to the invention has a modular construction with a plurality of connector banks, with the individual connector banks as such generally representing functional units. The connector banks generally have a plurality of individual coaxial connectors which are arranged in one or two rows. To this end, the individual coaxial connectors are secured in cutouts in a base body and, if required, have a floating bearing at least on a connector side in order to compensate for tolerances. Depending on the embodiment, the individual connector banks are operatively connected to one another, in a rigid manner or so as to move to a defined extent, at least at the cable end to form a larger unit. If required, the individual connector banks have centering means by means of which the individual connector banks are oriented and adjusted separately from one another. As an alternative or in addition, the individual connectors can serve as centering aids, depending on the field of application.

A plug connector according to the invention has one or more female and one or more male connector banks which each have one or two rows (for example 1×8 or 2×8) of individual (female and male) connectors which are operatively connected to one another and have a preferably coaxial construction. The housing of the connector banks (in particular at the cable end) and the arrangement of the individual connectors in the connector banks allows a high packing density. It has been found that connector banks with more than two rows of individual connectors, which cannot be mounted from the side in a manner according to the invention, can be produced only with great difficulty. If required, the individual connector banks can be operatively connected in a floating or rigid manner to form larger units. Floating connections can be produced by elastic elements or an external housing. Rigid connections can be achieved by an external housing accommodating the individual connector banks or by screwing, adhesive bonding, welding and/or by means of snap-action connections. Good results for a floating bearing are achieved by laterally arranged elastic connecting elements which operatively connect the individual connector banks to one another.

In one embodiment, the individual connectors on one connector side can be directly connected to a corresponding number of coaxial cables and then be pressed or inserted into cutouts in a housing which are arranged on one or two (opposite) sides of a base body. If required, the cutouts can be closed by means of covers.

On the opposite side, a corresponding number of connectors can be arranged in a one- or multi-piece housing and interact with a printed circuit board or likewise be secured to a corresponding number of coaxial cables. The housing, on the opposite side, can be produced from a conductive material, for example metal, or a plastic which is coated with a conductive layer, and take on the function of shielding. The housing can be intended for mounting on a printed circuit board.

A multiple coaxial connector according to the invention can have, if required, a modular construction at least on one housing side, for example at the cable end (where the cables are connected), said modular construction allowing configurations which can be expanded in various ways, for example 1×8, 2×8 or n×8 (n is an arbitrary number) or n×2×8. It is clear to a person skilled in the art that a number of connectors per row which differs from 8 is possible depending on the field of application. One advantage is that the plug connector, on account of the improved accessibility amongst other things, can be fabricated in a simpler manner and different embodiments can largely be assembled from identical parts. The individual housing parts can, if required, be connected to one another in a floating manner, for example by means of elastic connecting elements, for example comprising rubber or similar materials, which are arranged to the side of or between said housing parts. As a result, certain tolerances can be compensated for during the course of connection to a mating element, and the tolerance chains can be interrupted.

To this end, the individual connectors on each side of the connector are pressed into one or more housings which serve to hold said connectors—in a rigid or floating manner depending on the embodiment. The housing preferably comprises injection-molded plastic. The operative connection to the cables is established by pressing or soldering.

If required, the individual connectors have spring elements by means of which the plugging force with the mating piece is determined and any deviations are compensated for to a defined extent. Depending on the embodiment, the spring elements take, for example, the form of a bellows or have a barrel-like design which, if required, is slotted in the longitudinal direction or at a certain angle to said longitudinal direction in such a way that the load level does not exceed a certain value.

A connector is typically suitable for bandwidths of 25 GHz or higher in the case of SMD-mountable perpendicular PCB connectors. The special construction firstly allows densities of 100 channels or more per square inch. The spacing between two individual connectors (center-center pitch) is typically at most 2 mm. A further advantage is that the technology is suitable for series production and the connectors can be produced in a cost-effective manner. The aim is achieved by a reduction to the essential elements of a coaxial interface of printed circuit board (PCB) to cable connector.

The concept according to the invention allows, amongst other things, microscopic dimensions. For cost-effective manufacture, the metal parts are preferably designed such that they are suitable for production by means of stamping and bending, or deep-drawing, techniques; the housing is preferably designed such that it can be produced from injection-molded plastic.

The principle of orientation is based on the individual connector banks being centered individually and largely independently of one another by means of centering elements. The principle of orientation is therefore made even finer by means of centering pins and the outer conductor in relation to the inner conductor. An n×16 configuration is realized by means of loosely coupled 1×16 connectors, so that no tolerance chains are formed over more than 16 connectors.

One field of application for connectors according to the invention with a high channel density is testing and measuring in the production or development of serial high-speed data transmission components. In this case, many serial high-speed channels (currently around 6 to 15 gigabits per second, Gbps) are transmitted in parallel. For a higher quality, each channel is preferably differentially operated for each direction. A "full duplex" connection requires four physical connections.

In measurement technology, the signals should be transmitted with as little interference as possible, and therefore the connections are preferably routed coaxially. The signals are generated in integrated silicon circuits. Therefore, for a high signal quality, the line lengths to the PCB should be kept as short as possible. Since the spacing between the signal pad and the chip housing is a few tenths of a millimeter, the line length will be shorter the more densely the coaxial connector can be mounted on the chip housing, and therefore the smaller and denser the entire connection will be. Embodiments, for example the described "1×8" or the "2×8" variants, with an approximately 2 mm center-center spacing are particularly suitable for this purpose. Depending on requirements, 2 or 4 serial full duplex channels can be operated.

A further field of application is in the "automated test equipment" market with the so-called "test heads" required there. In this case, many serial connections are routed from a so-called "load board" of a test head to a measuring station. A typical example is an existing digital IC such as a processor, graphics chip or similar components which contain a large number of serial channels and typically achieve data rates up to 6 Gbps at the present time. Data rates of up to 15 Gbps are expected in the future. The number of channels can reach 100 or more per chip. A high-quality multichannel connector with a corresponding number of channels is required for this purpose. 100 channels per square inch is advantageous on account of the restricted space conditions on the load board and the PCB connections which are preferably as short as possible. This can be achieved in a cost-effective manner with a connector according to the invention.

Other potential applications can be found in general measurement technology, generally in digital high-speed data transmission or digital signal processing (for example in mobile-radio base stations). However, a family which leads to a new standard can also be developed on account of the flexibility and the small dimensions of the new connector which are easy to achieve. High-quality data transmission with a large number of channels is possible by virtue of the refinement of the connectors according to the invention.

In one embodiment, the multiple coaxial connector comprises a female and at least one cable-end male connector part. The cable-end connector part has at least one connector bank with a housing which has a base body. The base body has cutouts which are arranged in comb-like manner, are accessible from one or two opposite sides and serve to laterally receive individual connectors. The cable-end connector part can have a plurality of connector banks which are operatively connected laterally alongside one another and to one another. The cable-end connector banks can be operatively connected to one another in a floating manner, for example by means of elastic connecting elements. Depending on the embodiment, the cable-end connector banks can also be operatively connected to one another in a rigid manner. The female connector part, which is fixed, for example, rigidly on a circuit board, can have a one-piece housing with openings which run in parallel and serve to receive individual connectors. The connectors can be pressed or snapped into the female connector part from the front or rear side. If required, the one-piece housing can have a plurality of rows of openings. In order to compensate for geometrical deviations, the individual connectors can be mounted in a laterally floating manner at least in one housing. The connector banks can, if required, have centering means by means of which the housings are centered with respect to one another during the course of the plug-connection process.

BRIEF DESCRIPTION OF THE DRAWINGS

The invention will be explained in greater detail on the basis of embodiments shown in the following figures, in which:

FIG. 1 shows a perspective view of a first embodiment of a multiple coaxial connector obliquely from the front and below;

FIG. 2 shows the multiple connector according to FIG. 1 obliquely from above and the front;

FIG. 3 shows the multiple connector according to FIG. 1 in the open and partially sectioned state;

In the figures, the same reference symbols are used for corresponding parts.

DETAILED DESCRIPTION OF THE EMBODIMENTS

Figure 4:
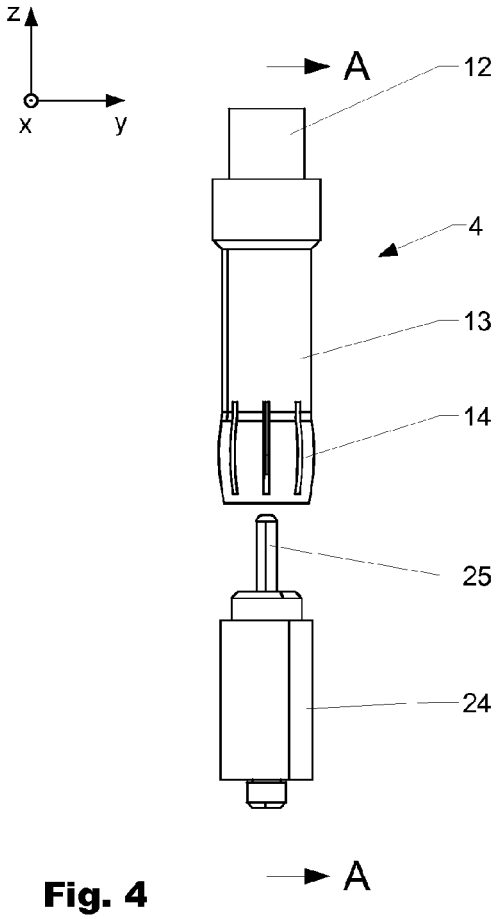
FIG. 4 shows a side view of an individual connector.

FIG. 1 shows a perspective illustration of a first embodiment of a multiple coaxial connector 1 obliquely from the front and below. FIG. 2 shows the same multiple connector 1 obliquely from the front and above, and FIG. 3 shows an open and partially sectioned illustration of the multiple connector obliquely from above.

The multiple coaxial connector 1 comprises a male and a female connector bank 2, 3, which connector banks can be operatively connected to one another by a plug-connection process. The two parts 2, 3 have a plurality of male and female, here coaxial, connectors 4, 5 which are arranged in a common upper first and second lower, one- or multi-piece external housing 6, 7. The male and female coaxial connectors 4, 5 are illustrated on an enlarged scale in FIGS. 4 and 5. In the figures, the male and the female connectors 4, 5 and, respectively, the connector banks 2, 3 are illustrated in a state in which they are separated from one another (not operatively connected), so that the individual details can be seen more clearly. Guide pins 27 are arranged on the housing 6 of the male connector bank 2, said guide pins engaging in centering openings 28, which are provided for them, in the second housing 7 when said male connector bank is operatively connected to the female connector bank 3 and aligning the housings of the individual connector banks 2, 3 with respect to one another. A connector bank 2, 3 of the embodiment shown has 16 connectors in each case, said connectors being coupled to one another, so that no tolerance chains are formed over more than 16 connectors. In order for the coaxial connectors 4, 5 to be aligned with one another during the course of the connection process, they can, as an alternative or in addition, be mounted so as to float in a lateral direction in one of the housings 6, 7 on at least one side.

As shown in FIG. 3, the external housing 6 of the male connector bank 2 of the multiple coaxial connector 1 is of multi-piece design. It has a base body 8 with cutouts 9 which are arranged in a comb-like manner and are suitable for receiving male connectors 4. The cutouts 9 are arranged on two opposite sides of the base body 8 and have a parallel orientation in relation to one another. They are arranged in two rows and laterally offset in relation to one another with reference to the basic outline, here at an angle of 60°, (other forms of the arrangement are possible). The base body 8 can be easily fitted with connectors 4, 5 with a high packing density on account of its cutouts 9 being designed to be accessible from both sides. The cutouts 9 can be designed in such a way that the connectors 4 can be laterally snapped into said cutouts.

Covers 10 are arranged on both sides of the base body 8, said covers closing off the base body 8 from the outside and preventing connectors 4, 5 which are inserted into the cutouts 9 from falling out. In the embodiment shown, cutouts 9 are formed in a C-shape on both sides, and therefore they completely surround the connectors 4 in the mounted state.

Depending on the field of application, the covers 10 can be adhesively bonded, screwed, welded or detachably or permanently operatively connected by means of snap-action connections to the base body 8. The connectors 4 can be arranged in the cutouts 9, in a fixed manner or so as to move to a defined extent, in such a way that they have a certain tolerance, at least laterally. Depending on the field of application, the cutouts 9 can also be formed in a U shape, so that the individual connectors 4 can be snapped into said cutouts from the side and no cover is required.

In contrast to the first housing part 6, the second housing part 7 of the embodiment shown is of one-piece design and is intended to be mounted on a circuit board (not illustrated in greater detail). The second housing part 6 has a plurality of openings 11 which run in parallel and are suitable for receiving connectors 5. The female connectors 5 are pressed into the openings 11 for this purpose. In the embodiment shown, the shield is formed by the second housing part 7 which is designed to be conductive in this case. If required, the second housing 7 can have more than two rows of connectors 5.

The housing parts 6, 7 are preferably produced from plastic or metal and are, if required, coated with a conductive material at least in some regions. The housings 6, 7 of the embodiments shown are designed such that they are suitable for being produced by injection-molding plastic or another material.

Undercuts which cannot be demolded are avoided on account of the multi-piece construction.

The connector banks 2, 3 have a two-row construction which allows a compact arrangement of the individual connectors and therefore a high density of channels per unit area since the individual connectors can be positioned very close to one another. Connectors with more than two rows are substantially more difficult to mount—particularly at the cable end. Optimum utilization in the case of very high channel densities per unit area is achieved at least at the cable end with one-row connector banks which are accessible from one side or two-row connector banks which are accessible from one or two sides. If the connector is intended to be mounted on a printed circuit board or the like on one side, more than two rows can be provided on this side. The base bodies 8 can, if required, be designed such that they serve as covers for a base body which is arranged adjacent to them.

Figure 5:
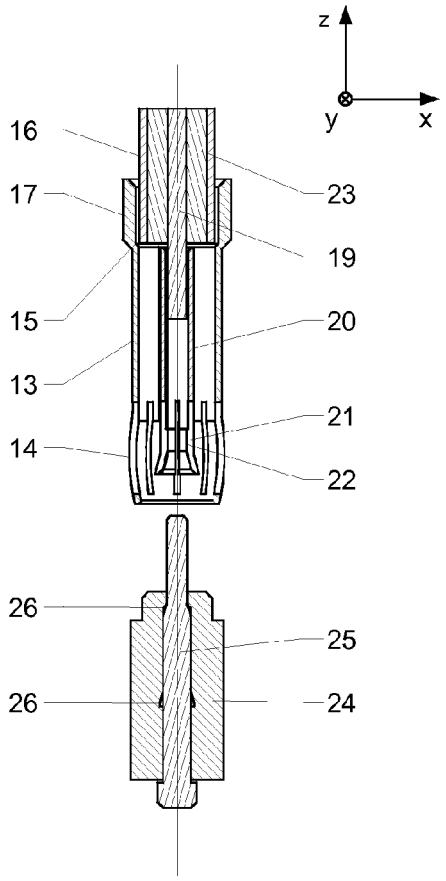
FIG. 5 shows a sectional illustration through the connector according to FIG. 4 along line AA.

As can be seen in FIGS. 3 to 5, the male connectors 4 are each fitted directly to a coaxial cable 12. The manner of construction of the connectors 4, 5 is relevant to the packing density which can be achieved. For this reason, high integration and a particularly compact construction have been ensured in connectors 4, 5.

The male connectors 4 have a sleeve-like electrically conductive outer part 13 which, at its front end, expands in the manner of a barrel and is provided with a plurality of slots 14 which run in the longitudinal direction in this case, and therefore a better spring action is achieved. At the rear end, the sleeve-like outer part 13 has, in the interior, a shoulder 15 which serves as a stop for an outer jacket or a shield 16 of the coaxial cable 12. On the outer face, the outer part 13 has a first thickened portion 17 which engages with a correspondingly formed groove 18 when the housing 6 is in the mounted state (cf. FIGS. 1 to 3). The thickened portion 17 and the groove 18 are designed such that they prevent the connectors from accidently moving in the axial direction in the mounted state. In the case of a stamped-and-bent part, the thickened portion 17 can be achieved by a local widening given a constant wall thickness.

The sleeve-like outer part 13 is fixed to the outer jacket 16 of the coaxial cable 12. Depending on the field of application, various types of fixing means are used. Good results are achieved by pressing, adhesive bonding or soldering. A first inner part 20, which is likewise sleeve-like, is plugged onto an inner conductor 19 of the coaxial cable 12, said first inner part being conically widened at the front end and being provided with slots 21, so that the spring force does not exceed a defined extent. In order to improve contact, the sleeve-like inner part 20 has an inwardly projecting second thickened portion 22. The spacing between the sleeve-like outer part 13 and the inner conductor 19 is created by an insulation means 23 for the coaxial cable 12. In addition, further spacer means, for example composed of plastic or another non-conductive material, can be provided in the male connector 4 between the outer part 13 and the first inner part 20 if required.

In the embodiment shown, the female connector 5 comprises an insulating spacer sleeve 24 and a pin-like second inner part 25. The second inner part 25 is pressed into the spacer sleeve 24 and has anchoring elements 26 which prevent accidental movement. The rear end is of thickened design and projects beyond the housing 7 in the mounted state (cf. FIG. 3) and serves as a contact to a printed circuit (not illustrated in greater detail).

As can be seen in FIG. 3, the female connector parts 5 are pressed into the opening 11 in the second housing from the rear and are arranged in the interior of said second housing in the mounted state. In the embodiment shown, the female connectors do not have a shield. This is provided by the second housing 7 which is produced either entirely of conductive material or is coated with a conductive material at least in the region of the inner surface of the openings 11. In the operatively connected state, the conductive outer parts 13 of the male connectors 5 form a conductive connection to the inner faces of the openings 11 (outer conductors). At the same time, the sleeve-like first inner parts 20 and the pin-like second inner part 26 are likewise operatively connected in this state and form an operative connection for transmitting radio-frequency signals (inner conductors).

Figure 6:
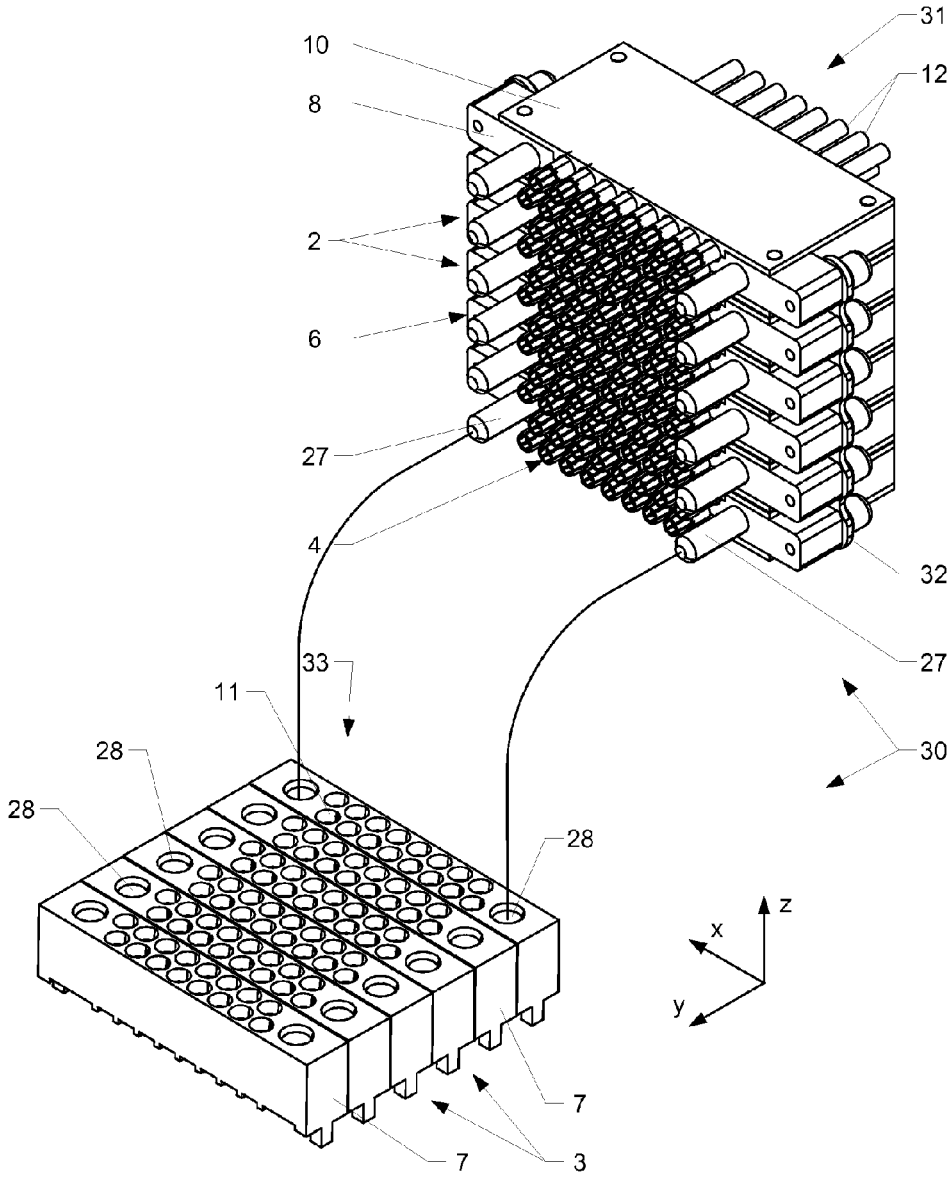
FIG. 6 shows a perspective illustration of one embodiment of a multiple coaxial connector array (u=6) obliquely from above and the front.

FIG. 6 shows a perspective illustration of an embodiment of a multiple coaxial connector array 30. The connector 30 has a modular construction with a high number of channels per unit area. In the embodiment shown, the male connector part 31 comprises individual connector banks 2 which are operatively connected alongside one another in parallel and to one another in a floating manner by means of laterally arranged elastic mounts 32. Depending on the field of application, the connector banks 2 can also be connected to one another in a rigid manner if required. The coaxial connectors 4, 5 can likewise also be mounted in the housings 6, 7 in a laterally floating manner to a defined extent if required.

In the embodiment shown, the housing of the female connector part 33 comprises a plurality of individual connector banks 3, as described in FIGS. 1 to 3. The connector banks 3 are mounted alongside one another on a printed circuit.

Figure 7:
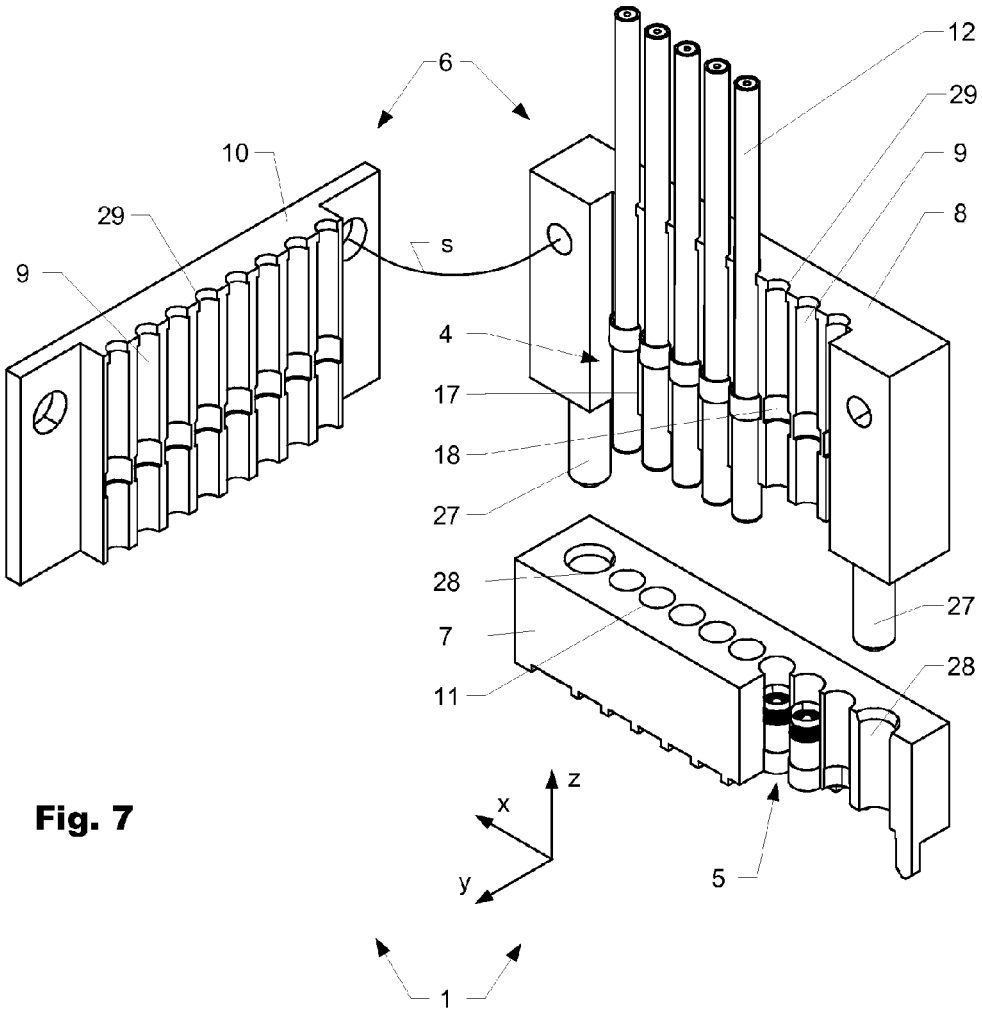
FIG. 7 shows a perspective illustration of a second embodiment of a multiple coaxial connector obliquely from the front and above.

FIG. 7 shows a perspective illustration of a second embodiment of a multiple coaxial connector 1 obliquely from above. The construction corresponds substantially to that of the connector 1 according to FIGS. 1 to 3. Therefore, reference is made to these figures for the description of the general manner of operation. For improved understanding, the first housing 6 is illustrated in the open state and the second housing 7 is illustrated partially in section.

In contrast to the connector according to FIGS. 1 to 3, the connector shown here is of one-row design. The housing 6 of the male connector bank 2 is of two-piece design and comprises a base body 8 which has a plurality of cutouts 9, which are arranged alongside one another, for receiving cables 12 and male coaxial connectors 4 which are operatively connected to said cables. The connectors 4 have thickened portions 17 which, in the mounted state, are arranged in grooves 18 provided for them and prevent movement in the longitudinal direction. A cover 10 which is likewise provided with a corresponding number of cutouts 9 serves to close the housing 6 (schematically illustrated by line s). In the rear region of the cutouts 9, the base body 8 and the cover 10 have constricted portions 29 which are dimensioned such that the cables 12 are clamped in a controlled manner in this region in the closed state for the purpose of strain relief. The female connector bank 3 is likewise of one-row design. The female connectors 5 are likewise pressed into the second housing 7 from the rear in the embodiment shown.

Figure 8:
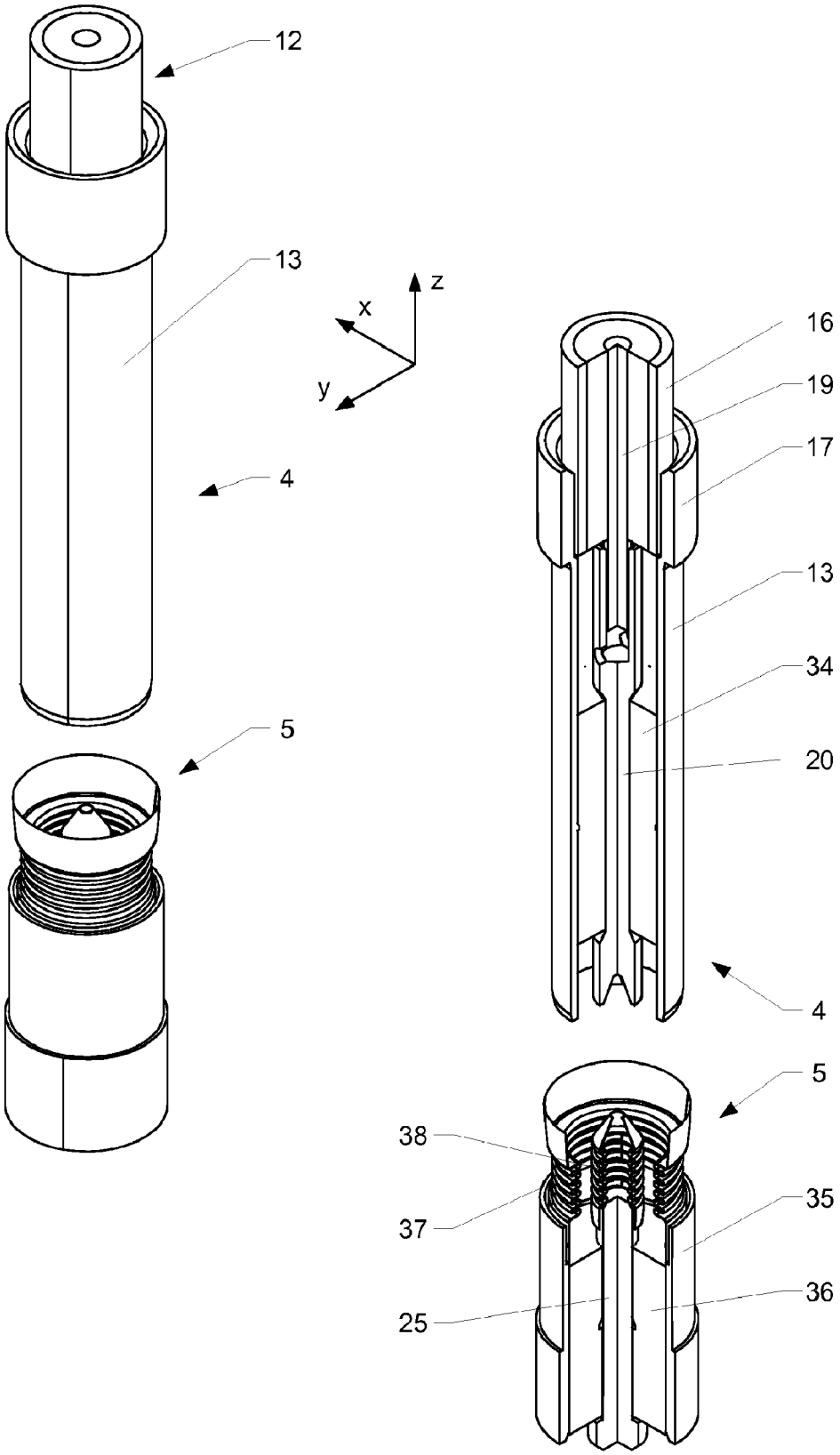
FIG. 8 shows a partially sectioned perspective illustration of two individual connectors from the multiple connector according to FIG. 7 obliquely from the front and above.

FIG. 8 shows a perspective illustration of two male and two female connectors 4, 5, in each case one above the other. In the front connector pair 4, 5, a front region of 90° is cut away, so that the interior of the connectors 4, 5 is more clearly visible. The connectors 4, 5 correspond to the connectors 4, 5 of the third embodiment of the multiple coaxial connector 1 according to FIG. 7 but can, in principle, also be used in an embodiment which is shown in one of the preceding figures.

The male connectors 4 have, in the interior, a first spacer sleeve 34 which is arranged between the sleeve-like outer part 13 and the first inner part 20 which is connected to the inner conductor 19 of the coaxial cable 12 and which spaces said sleeve-like outer part and first inner part apart from one other. The spacer sleeve 34 is generally produced from an insulating material and serves to hold the parts.

In this case (in contrast to the embodiment according to FIGS. 4 and 5), the female connector 5 has an outer conductor 35 which is arranged so as to be spaced apart from the second inner part 25 by means of a second spacer sleeve 36. In the plug-connected state, the outer conductor 35 interacts with the sleeve-like outer part 13 of the mating piece 4, while the first inner part 20 is conductively connected to the second inner part 25 in the plug-connected state.

In order for the connection between the individual parts to be established in a reliable manner and to compensate for certain geometric deviations in the longitudinal and transverse direction, both the outer conductor and the second inner part have a bellows 37, 38. In contrast to the connectors 4, 5 according to FIGS. 4 and 5, which interact with one another laterally, the connectors 4, 5 shown here interact by means of end-face contacts.

LIST OF REFERENCE SYMBOLS

1 Multiple connector
2 Male connector bank
3 Female connector bank
4 Male connector
5 Female connector
6 First housing
7 Second housing
8 Base body
9 Cutout
10 Cover
11 Openings
12 Coaxial cable
13 Sleeve-like outer part
14 Slots
15 Shoulder
16 Outer jacket/shield
17 First thickened portion
18 Groove
19 Inner conductor
20 First inner part
21 Slots
22 Second thickened portion
23 Insulation means
24 Spacer sleeve
25 Second inner part
26 Anchoring element
27 Guide pin
28 Centering opening
29 Constricted portion
30 Cable-end connector part
31 Male connector part
32 Elastic mount
33 Female connector part
34 First spacer sleeve
35 Outer conductor
36 Second spacer sleeve
37 First bellows
38 Second bellows

What is claimed is:

1. A multiple coaxial connector comprising:

a female connector part; and a cable-end male connector part, with the cable-end male connector part including a modular construction with a plurality of connector banks including a housing with a base body which has cutouts which are accessible from one or two opposite sides and serve to laterally receive and hold individual connectors in the connector bank, wherein the cable-end connector banks are arranged such that they are movable relative to one another, wherein the individual connectors in the connector bank are each configured to be fitted directly to a coaxial cable, wherein the individual connectors include a sleeve-like electrically conductive outer part which is to be fixed to an outer jacket of the coaxial cable, and wherein the individual connectors include a sleeve-like inner part which is to be plugged onto an inner conductor of the coaxial cable, whereby a space between the sleeve-like outer part and the inner part includes an insulator.

2. The multiple coaxial connector of claim 1, wherein the cable-end connector banks are operatively connected to one another in a floating manner via elastic connecting elements.

3. The multiple coaxial connector of claim 1, wherein a connector bank includes one or two rows of connectors.

4. The multiple coaxial connector of claim 1, wherein the female connector part includes a one-piece housing with openings which run in parallel and serve to receive individual connectors.

5. The multiple coaxial connector of claim 4, wherein the connectors are pressed in from the rear side.

6. The multiple coaxial connector of claim 4, wherein the one-piece housing includes a plurality of rows of openings.

7. The multiple coaxial connector of claim 1, wherein the individual connectors are mounted in a laterally floating manner at least in one housing.

8. The multiple coaxial connector of claim 1, wherein the connector banks include centering means by means of which the housings are centered with respect to one another during the course of a plug-connection process.

9. The multiple coaxial connector of claim 5, wherein the one-piece housing has a plurality of rows of openings.

10. The multiple coaxial connector of claim 8, wherein the connector banks are centered separately and substantially independently from each other.

11. The multiple coaxial connector of claim 10, wherein the centering means are arranged on a front side of the housings of the connector banks.

12. The multiple coaxial connector of claim 1, wherein the insulator is insulation of the coaxial cable.

13. The multiple coaxial connector of claim 1, wherein the insulator comprises a spacer composed of a non-conductive material which is provided in the individual connectors between the outer part and the inner part.

14. A multiple coaxial connector comprising:

a female connector part; and a cable-end male connector part, the cable-end male connector part including:

a modular construction with at least one connector bank including a housing with a base body which has cutouts which are accessible from one or two opposite sides and serve to laterally receive and hold individual connectors in the connector bank, the individual connectors including a sleeve-like electrically conductive outer part and a sleeve-like inner part, and a plurality of individual connector banks which are operatively connected alongside one another in parallel and to one another in a floating manner by means of laterally arranged elastic mounts.

* * * * *